United States Patent [19]

Nomiya et al.

[11] 3,973,254

[45] Aug. 3, 1976

[54] ARRANGEMENT FOR A DYNAMIC DISPLAY SYSTEM

[75] Inventors: Kosei Nomiya, Tokyo; Takao Tsuiki, Kokubunji, both of Japan

[73] Assignee: Hitachi, Ltd., Japan

[22] Filed: Dec. 22, 1972

[21] Appl. No.: 317,775

[30] Foreign Application Priority Data

Dec. 22, 1971 Japan ..... 46-103712

[52] U.S. Cl. ..... 340/336; 178/69 G; 340/343

[51] Int. Cl.[2] ..... G09F 9/32

[58] Field of Search ..... 340/336, 343, 324 R; 178/69 G

[56] References Cited

UNITED STATES PATENTS 3,432,846 3/1969 Jones et al. ..... 340/324 R 3,603,965 9/1971 Somlyody ..... 340/324 R

*Primary Examiner*—Marshall M. Curtis

*Attorney, Agent, or Firm*—Craig & Antonelli

[57] ABSTRACT

A digital display system of the dynamic pulse-lighting type for electronic desk-top calculators and the like, characterized in that a blanking signal having a pulse width large enough to cover each border time between adjacent display timing signals is used to shut off the power supply to the display devices for each pulse duration to suppress any flicker of the display unit which might otherwise result from non-synchronism or overlapping of the display signals.

7 Claims, 17 Drawing Figures

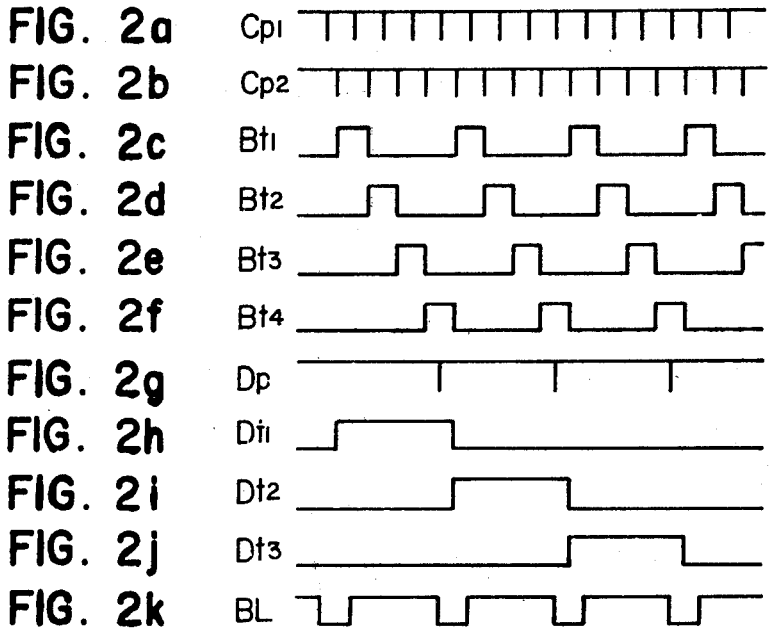
FIG. 2a
Cp1
FIG. 2b
Cp2
FIG. 2c
Bt1
FIG. 2d
Bt2
FIG. 2e
Bt3
FIG. 2f
Bt4
FIG. 2g
Dp
FIG. 2h
Dt1
FIG. 2i
Dt2
FIG. 2j
Dt3
FIG. 2k
BL
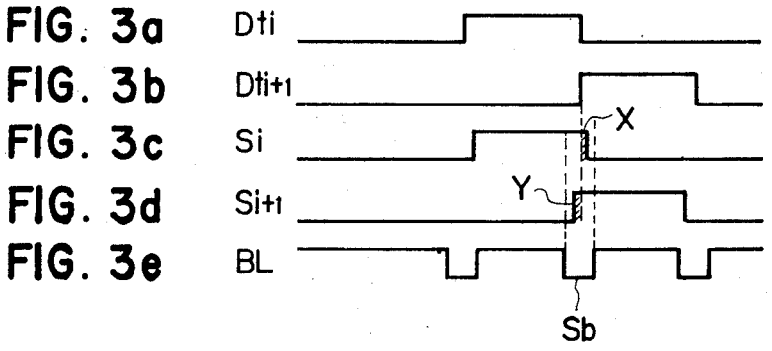
FIG. 3a
Dti
FIG. 3b
Dti+1
FIG. 3c
Si
X
FIG. 3d
Si+1
Y
FIG. 3e
BL
Sb

ARRANGEMENT FOR A DYNAMIC DISPLAY SYSTEM

BACKGROUND OF THE INVENTION

This invention relates to a digital display system for electronic desk-top calculators, and more specifically to a dynamic (pulse lighting) display system for lighting display devices in a time-sharing manner.

Generally, digital display systems are classified into static and dynamic display types. For electronic desk-top calculators and the like, the classic static systems are being supplanted by the dynamic display types which permit reduction in the numbers of decoder circuits, drive circuits, etc., that the static type require for each of the digits of the numbers to be handled. The dynamic display system, which takes advantage of the afterimage effect of the human eyes, sequentially lights a plurality of display devices with pulses in a time-sharing manner, thereby reducing the overall number of decoder and drive circuits to a quantity which is just enough for one digit. For this purpose, it is important to establish accurate synchronism between the timing pulses (timing signals) and display signals for pulse lighting the display devices. Actually, however, the lag of display signals due to their passage through the decoder and drive circuits, etc., and the lag of timing signals due to their passage through buffer circuits, etc., have presented the problem of imperfect synchronism between the display and timing signals. The imperfect synchronism in turn causes flicker (double lighting) of the display devices. The flicker also stems from overlapping of the display signals.

SUMMARY OF THE INVENTION

It is therefore a principal object of the present invention to provide a quite novel dynamic display system which avoids the disadvantages of the prior art.

Another object of the invention is to provide a dynamic display system capable of precluding flickering of the display devices.

Still another object of the invention is to provide a dynamic display system capable of preventing flickering of the display devices due to non-synchronism between the display signals and the display timing signals.

A further object of the invention is to provide a dynamic display system capable of preventing flickering of the display devices due to overlapping of the display signals.

BRIEF DESCRIPTION OF THE DRAWINGS

FIGS. 2*a–k* and 3*a–e* are timing charts explanatory of the functions of the system shown in FIG. 1.

DETAILED DESCRIPTION

Figure 1:
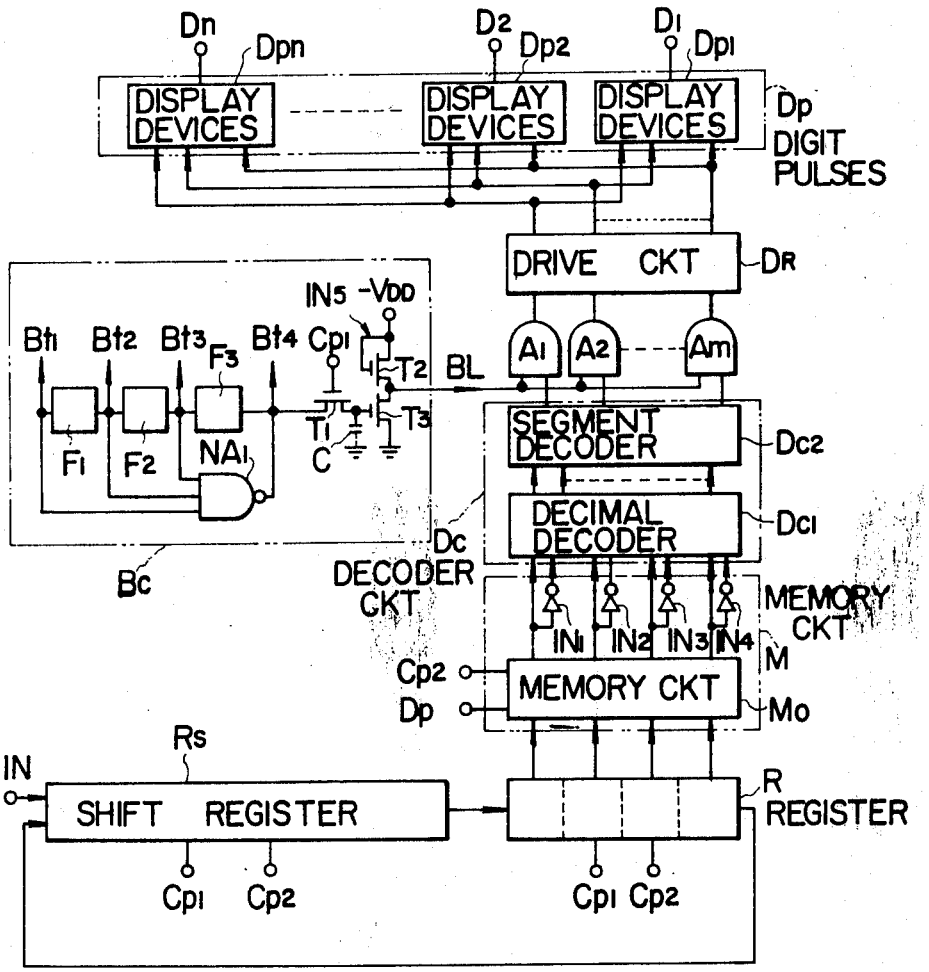
FIG. 1 is a block diagram of a dynamic display system embodying the present invention.

This invention will now be described in detail with reference to the accompanying drawings showing an exemplary embodiment thereof.

In FIG. 1, which illustrates a dynamic display system according to the present invention, the reference symbol $R_S$ represents a shift register and R represents a register of four bit capacity for one decimal digit to which the output from the shift register $R_S$ is supplied. The contents of the register R are fed back in sequence to the input of the dynamic shift register $R_S$. The symbol Mo designates a memory circuit to which the bit outputs from the register R are supplied and in which four-bit serial signals stored by the register R are read in parallel by digit pulses Dp having a cycle corresponding to the length of the four-bit signal.

The memory circuit Mo is combined with inverters $IN_1$–$IN_4$ to form a memory circuit M. The output from the memory circuit M is supplied to a decimal decoder $DC_1$, in which binary numbers are converted into decimal numbers. A segment decoder $DC_2$ is provided for converting the output signals from the decimal decoder DC into signals for lighting certain display devices for certain numerals. The decimal decoder $DC_1$ and the segment decoder $DC_2$ constitute a decoder circuit DC.

A blanking circuit for generating a signal BL for controlling the output signals or display signals from the decoder circuit DC is generally designated BC. This circuit produces a blanking signal BL by causing a bit signal $Bt_4$ from a ring counter to be delayed by half a bit by an insulated-gate field effect transistor $T_1$ (IGFET) and by allowing inverter circuit $IN_5$ consisting of IGFET's $T_2$ and $T_3$ to generate an inverted version of the delayed bit signal.

Control AND gates $A_1 - A_m$ are so arranged as to receive the blanking signal BL and output signals from the decoder DC. A drive circuit DR is provided for driving display devices to which output signals from the AND gates $A_1 - A_m$ are supplied. Where Nichsi tubes are employed as display devices, the segment decoder $DC_2$ is not required because the decimal decoder $DC_1$ alone can serve the purpose. Generally indicated at DP is a display unit consisting of positional display devices $DP_1 - DP_n$ for receiving outputs from the drive circuit DR. In this circuit the symbol $DP_n$ signifies the display device in the n-th position. Symbols $D_1 - D_n$ denote input terminals for display timing signals $Dt_1 - Dt_n$ connected, respectively, to the display devices $DP_1 - DP_n$ in the corresponding positions.

Next, various timing pulses for use in the embodiment under consideration will be explained in conjunction with FIG. 2.

Clock pulses $Cp_1$ and $Cp_2$ (also called shift pulses) are staggered in phase with respect to each other and are used to drive the shift register $R_S$ and the register R. The circuits which provide such clock pulses are well known since they are often employed in many different circuits, as well as in electronic desk-top calculators. Bit signals $Bt_1 - Bt_4$ are generated by the ring counter using the clock pulses $Cp_1$ and $Cp_2$ are synchronized with the clock pulse $Cp_2$. They are used in separate circuits wherein parallel binary signals from an encoder (not shown) are converted into serial signals, and therefore the first to fourth bits in each position of the binary-coded decimal signals that circulate through the registers $R_S$ and R are synchronized, respectively, with the bit pulses $Bt_1 - Bt_4$. A digit pulse Dp can be synthesized from the clock pulse $CP_1$ and bit signal $Bt_4$, and its characteristic equation is written in the form $$Dp = CP_1 \cdot Bt_4$$

Display timing signals $Dt_1 - Dt_n$ have a pulse width equal to the sum of the pulse widths of the bit signals $Bt_1 - Bt_4$, or equal to a decimal position of a binary-coded decimal signal. The pulse cycle is governed by the memory capacities of registers $R_S$ and R. A blanking signal BL uses the bit signal $Bt_4$ delayed by half a bit as above stated, and is therefore in synchronism with the clock pulse $CP_1$.

In a dynamic display system in practical use, various conditions may cause non-synchronism between the data display signals and the display timing signals or may cause an overlap of data display signals in the manner already noted. Either may lead to flickering of the display unit $D_p$. According to the present invention, this flickering can be prevented by the use of the blanking signal BL from the blanking circuit BC. The flicker-killing function of the blanking circuit will be explained below with reference to FIG. 3.

FIGS. 3(*a*) through 3(*e*) represent time charts that indicate the relation among display timing signals $Dt_i$, $Dt_{i+1}$, display signals $S_i$, $S_{i+1}$, and a blanking signal BL in the dynamic display system of the present invention. Here, signal $Dt_i$ is the *i*-th display timing signal (1 *i* *n*) for lighting the display device in the *i*-th position; $Dt_{i+1}$ is the display timing signal for the next (*i*+1)-th display device; $S_i$ is the display signal in the *i*-th position to be displayed on the *i*-th display device by the display timing signal $Dt_i$; and $S_{i+1}$ is the display signal for the (*i*+1)-th position. The display signals $S_i$ and $S_{i+1}$ are, for example, output signals from the decoder circuit DC. While the blanking signal is at a low level, the AND gates $A_1 - A_m$ remain closed, and therefore the display signals $S_1 - S_n$ are not fed to the drive circuit DR and the display devices $D_1 - D_n$ are not lighted.

Assuming now that the *i*-th display signal $S_i$ is delayed from the *i*-th display timing signal $Dt_i$ as indicated in FIG. 3(*a*) and FIG. 3(*c*), an X portion, which is hatched in FIG. 3(*c*), of the display signal $S_i$ for the *i*-th display device $Dp_i$ will tend to be displayed on the display device $Dp_{i+1}$ in the next position by the action of the following display timing signal $Dt_{i+1}$, but the blanking signal BL will keep the X portion from being displayed. It will be seen that if the blanking signal BL is not applied the X portion will cause flicker of the display unit.

Similarly, if the (*i*+1)-th display timing signal $Dt_{i+1}$ lags behind the (*i*+1)-th display signal $S_{i+1}$ as shown in FIG. 3(*c*) and FIG. 3(*d*), a Y portion, which is hatched in FIG. 3(*d*), of the display signal $S_{i+1}$ to be displayed on the (*i*+1)-th display device $Dp_i$ will tend to be displayed on the display device $Dp_1$ in the preceding position. Here again the blanking signal BL will prevent the Y portion from being displayed.

Thus, according to the present invention, a blanking pulse Sb is provided which extends over the border time between the *i*-th display timing signal $Dt_i$ and the following (*i*+1)-th display timing signal $Dt_{i+1}$ and thereby bridges the two timing signals, so that neither of the display devices corresponding to the signals is lighted during the period equal to the duration of the blanking pulse Sb. Consequently, whether any display signal lags behind a display timing signal or vice versa, the signal portion X or Y that is out of synchronism is not displayed and, naturally, flickering of the display unit is prevented.

Although the blanking signal BL slightly shortens the lighting time of the display unit to about three-quarters of the full lighting period, it is practically negligible. Should any problem arise from it, the problem would be readily solved by increasing the voltage applicable to the display unit by the amount proportional to the decrement of the lighting time while maintaining the power consumption at an unchanged level. It has now been found that where light emission diodes or the like are employed as the display devices, the application of an increased voltage would rather enhance the luminous intensity of the display unit.

Also, in the case where the display signals in the adjacent positions are overlapped due to the difference between the rise-time characteristics of the active elements that are employed, for example, where as shown in FIG. 3(*c*) and FIG. 3(*d*), the *i*-th display signal $S_i$ and the (*i*+1)-th display signal $S_{i+1}$ are overlapped in the hatched portions X and Y, it is possible to eliminate the overlapping portions X and Y by means of blanking signals BL and thereby avoid flickering of the display unit.

Further, according to the present invention, the blanking pulses $S_b$ can be formed by staggering one of the bits, e.g., the bit signal $Bt_4$, for use on an electronic desk-top calculator or the like, by half a bit by means of a simple arrangement. No complicated circuit is required for this purpose.

While the present invention has been described in conjunction with a preferred embodiment thereof, it is to be understood, of course, that the invention is not in any way restricted thereto, but numerous alterations and modifications are possible without departing from the spirit of the invention.

For example, the blanking signal BL disposed inbetween the drive circuit DR and decoder circuit DC in the embodiment just described may be placed into or in the front or rear of the decoder circuit DC or drive circuit DR, instead, because its only function is to shut off the power supply to the display unit. Also, the blanking signal BL may be used to control the supply of display timing signals to the display unit in place of controlling the supply of display signals to the unit. The display devices to be adopted are not limited to Nichsi tubes; of course, digitrons, light emission diodes, liquid crystals, etc., may be used as well.

What is claimed is:

1. In a dynamic display system for pulse lighting display devices in a time-sharing manner, comprising a plurality of display devices, means for applying consecutive timing signals having a pulse width consisting of a plurality of bit times to the respective display devices for time-sharing energization thereof, and means for selectively applying indicia display signals to selected display devices to actuate said devices in selected combinations, said display devices being energized only upon coincident receipt of a timing signal and a display signal, the improvement comprising blanking means for generating blanking signals having a pulse width sufficient to cover the border time between adjacent display signal including the trailing portion of each display signal and the leading portion of the display signal subsequent thereto, means for gating said blanking signals with said display signals so as to prevent application of said display signals to said display devices during the period of the blanking signals, and delay means for delaying the last of said bit times by half a bit time, the pulse width of said blanking signals being equal to one bit time.

2. A dynamic display system for pulse lighting display devices in a time-sharing manner, comprising a plurality of display devices, means for applying consecutive timing signals to the respective display devices for time-sharing energization thereof, and means for selectively applying indicia display signals to selected display devices to actuate said devices in selected combinations, said display devices being energized only upon coincident receipt of a timing signal and a display signal, the improvement comprising blanking means for generating blanking signals having a pulse width sufficient to cover the border time between adjacent display signals including the trailing portion of each display signal and the leading portion of the display signal subsequent thereto and means for gating said blanking signals with said display signals so as to prevent application of said display signals to said display devices during the period of the blanking signals, said blanking means including a ring counter generating bit time signals, the last stage of said ring counter being connected to delay means for delaying the last bit time signal by half a bit time to produce said blanking signal.

3. A dynamic display system as defined in claim 2 wherein said delay means includes a first insulated gate field effect transistor connected to the last stage of said ring counter and means for applying clock signals to the base of said transistor.

4. A dynamic display system as defined in claim 3 wherein said delay means further includes a pulse inverter comprising a pair of insulated gate field effect transistors connected to said first field effect transistor.

5. A dynamic display system as defined in claim 1 wherein said means for selectively applying indicia display signals to selected display devices includes shift register means for storing a plurality of coded indicia display signals, memory means connected to said shift register means for selectively storing a coded indicia display signal, and decoder means connected to said memory means for decoding the signal stored in said memory means, said gating means connecting the output of said decoder means to said display devices for selective actuation thereof.

6. A dynamic display system In a dynamic display system for pulse lighting display devices in a time-sharing manner, comprising a plurality of display devices, means for applying consecutive timing signals to the respective display devices for time-sharing energization thereof, and means for selectively applying indicia display signals to selected display devices to actuate said devices in selected combinations, said display devices being energized only upon coincident receipt of a timing signal and a display signal, the improvement comprising blanking means for generating blanking signals having a pulse width sufficient to cover the border time between adjacent display signals including the trailing portion of each display signal and the leading portion of the display signal subsequent thereto and means for gating said blanking signals with said display signals so as to prevent application of said display signals to said display devices during the period of the blanking signals, said means for selectively applying indicia display signals to selected display devices including shift register means for storing a plurality of coded indicia display signals, memory means connected to said shift register means for selectively storing a coded indicia display signal, and decoder means connected to said memory means for decoding the signal stored in said memory means, said gating means connecting the output of said decoder means to said display devices for selective actuation thereof, said blanking means including a ring counter generating bit time signals, the last stage of said ring counter being connected to delay means for delaying the last bit time signal by half a bit to produce said blanking signal.

7. A dynamic display system as defined in claim 6 wherein said delay means includes a first insulated gate field effect transistor connected to the last stage of said ring counter and means for applying clock signals to the base of said transistor.

* * * * *